US006845848B1

(12) United States Patent
Kritzer

(10) Patent No.: US 6,845,848 B1
(45) Date of Patent: Jan. 25, 2005

(54) VEHICLE LIFT WITH ADJUSTABLE OUTRIGGERS

(75) Inventor: Jeffrey Scott Kritzer, Moorpark, CA (US)

(73) Assignee: Bond-Pak, Inc., Santa Paula, CA (US)

( * ) Notice: Subject to any disclaimer, the term of this patent is extended or adjusted under 35 U.S.C. 154(b) by 220 days.

(21) Appl. No.: 10/176,734

(22) Filed: Jun. 21, 2002

(51) Int. Cl.[7] ..... B66F 7/12
(52) U.S. Cl. ..... 187/221; 187/213
(58) Field of Search ..... 187/203, 204, 187/215, 216–221, 414; 254/89 R, 91

(56) References Cited

U.S. PATENT DOCUMENTS 1,519,357 A * 12/1924 Campbell ..... 187/217
4,267,901 A * 5/1981 Tsujimura ..... 187/220
5,330,315 A * 7/1994 Beattie et al. ..... 187/219
5,727,656 A * 3/1998 Gaudioso et al. ..... 187/221

* cited by examiner

*Primary Examiner*—Eileen D. Lillis
*Assistant Examiner*—Thuy V. Tran
(74) *Attorney, Agent, or Firm*—Erickson & Kleypas, L.L.C.

(57) ABSTRACT

An automobile service lift includes a plurality of generally vertical posts, each of which has a carriage moveably mounted thereon. Each carriage has an outrigger which extends outwardly from the carriage and supports a portion of the weight of a vehicle positioned on the lift. Each outrigger is pivotable relative to the respective carriage about a generally horizontal axis. Each carriage further includes an adjustment mechanism for selectively pivoting the respective outrigger to compensate for any deflection of the outrigger due to the weight supported thereon.

16 Claims, 2 Drawing Sheets

VEHICLE LIFT WITH ADJUSTABLE OUTRIGGERS

BACKGROUND OF THE INVENTION

1. Field of the Invention

This invention relates to the field of automobile service lifts, and in particular to a lift having adjustable outriggers which can compensate for deflection of the outriggers due to the weight of a vehicle on the lift.

2. Description of the Related Art

A wide variety of post-type automobile lifts have been previously known and used in the automobile repair business to provide access to the underside of a vehicle. Post lifts can be either of the in-ground or above-ground variety. In-ground post lifts usually have one or two vertically ascending columns mounted below the floor of a garage or service area which are raised hydraulically to lift the vehicle. Above-ground post lifts generally have two or four vertical columns or "posts," each of which includes a carriage which rides up and down the post. These carriages are often raised and lowered by means of a chain, cable, or other flexible lifting member which is driven by a winch or hydraulic actuator.

Each carriage has one or more arms or "outriggers" which extend outwardly from the carriage. On some lifts, the outriggers directly engage the undercarriage of a vehicle such that the wheels of the vehicle are unsupported after the vehicle is lifted. On other lifts (which are typically four post lifts) the outriggers of the two posts on each side of the lift support a platform or "runway" which supports the wheels of the vehicle. Lifts of this second type are often used for wheel alignment work because this type of maintenance requires that the wheels be supported and not hanging freely. Alignment lifts may include rotatable turntables mounted to the runways under the front wheels of the vehicle. These turntables allow the front wheels to be easily turned during the alignment process.

A problem with existing post-type lifts is that the outriggers can sag when a load is applied to them. This can cause the runways to become out of level. This problem is particularly detrimental when doing alignment work because the vehicle must be level for the adjustments to be made accurately. What is needed is a lift which allows the outriggers to be leveled to compensate for deflection due to the weight of the vehicle.

SUMMARY OF THE INVENTION

The present invention comprises a post type automobile service lift wherein each of the outriggers is pivotally connected to its respective carriage for movement about a generally horizontal axis. A respective adjustment mechanism is provided for selectively pivoting each outrigger to compensate for deflection of the outrigger caused by the weight being supported thereon.

In the preferred embodiment, each carriage includes a pair of generally vertical side plates. The respective outrigger is pivotally connected between the side plates by a generally horizontal pivot pin. The adjusting mechanism comprises a stop plate mounted between the side plates above the outrigger and inboard of the pivot pin. The stop plate includes a threaded receiver which receives an adjustment bolt. The adjustment bolt has a lower end which is in rotatable contact with an upper surface of the outrigger. By turning the adjustment bolt, a lift operator can raise or lower the outboard end of the outrigger upon which the weight of the vehicle is supported. This allows the operator to level the vehicle and/or the runways.

DETAILED DESCRIPTION OF THE PREFERRED EMBODIMENT

Figure 1:
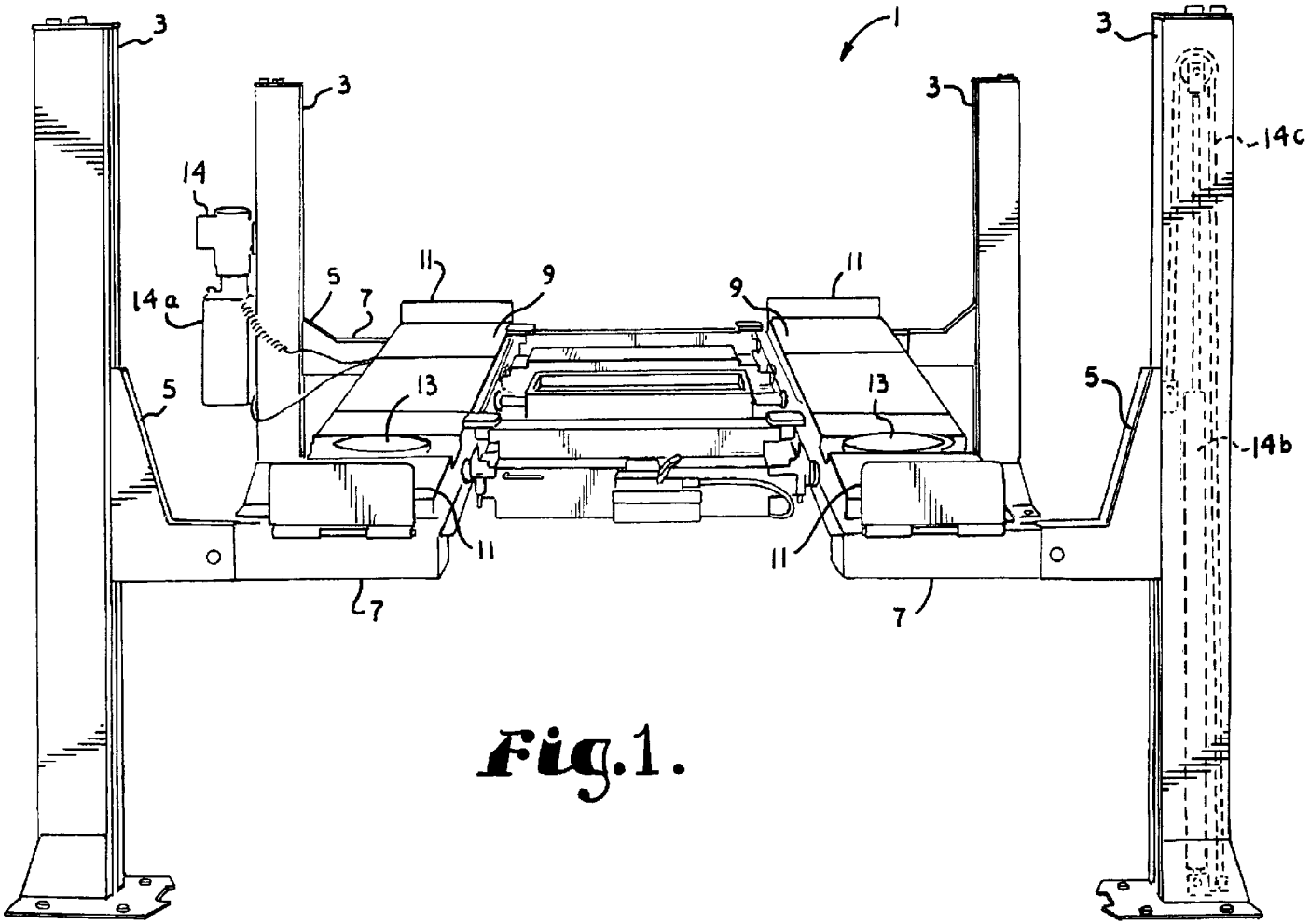
FIG. 1 is a perspective view of a four post alignment lift embodying the present invention.

As required, detailed embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardy" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, and in particular to FIG. 1, the reference number 1 generally designates an alignment lift having four posts 3. Each post 3 has a carriage 5 which is vertically moveable along the respective post 3. Each carriage 5 includes an outrigger 7 which extends from the respective carriage 5 toward the centerline of the lift 1. The outriggers 7 associated with each longitudinal pair of the posts 3 support opposed ends of a respective runway 9. The runways 9 each include ramps 11 which allow a vehicle (not shown) to be driven onto the runways 9. The runways 9 may each also include a turntable 13 which supports a respective front wheel of the vehicle and allows the wheel to be easily turned.

The carriages 5 are raised and lowered by a conventional drive mechanism 14, which may be hydraulic, mechanical, or a combination of hydraulic and mechanical components. For example, the drive mechanism 14 may comprise a hydraulic pump 14*a* connected to a respective hydraulic actuator 14*b* mounted in each of the posts 3. The drive mechanism 14 may further include flexible lifting members or lifting chains 14*c* which are connected between each carriage 5 and a point on the interior of the respective post 3 proximate its base. The lifting chains loop over a roller or sprocket on the respective hydraulic actuator 14*b* such that as the hydraulic actuators 14*b* are extended, the carriages 5 are raised.

An alternative drive mechanism 14 (not shown) could comprise a single hydraulic cylinder mounted in one of the runways 9 and connected to each of the carriages 5 through a respective cable and a system of pulleys. Such a drive mechanism is used on the PF-7000ST four post lift sold by Bend-Pak, Inc. In this system, each cable is connected at one end to the ram end of the cylinder and routed, via pulleys, to a respective outrigger. The cable passes through the respective outrigger and into the interior of the respective post. The second end of each cable is connected to a point proximate the top of the respective post. A pulley on each carriage engages the respective cable such that, as the cylinder is retracted, all of the carriages are lifted. Other possible drive mechanisms 14 might substitute pneumatic actuators or screw jacks (not shown) for the hydraulic actuators described above. Winches and cables (not shown) could also be employed as a drive mechanism 14 to raise the carriages 5.

Figure 2:
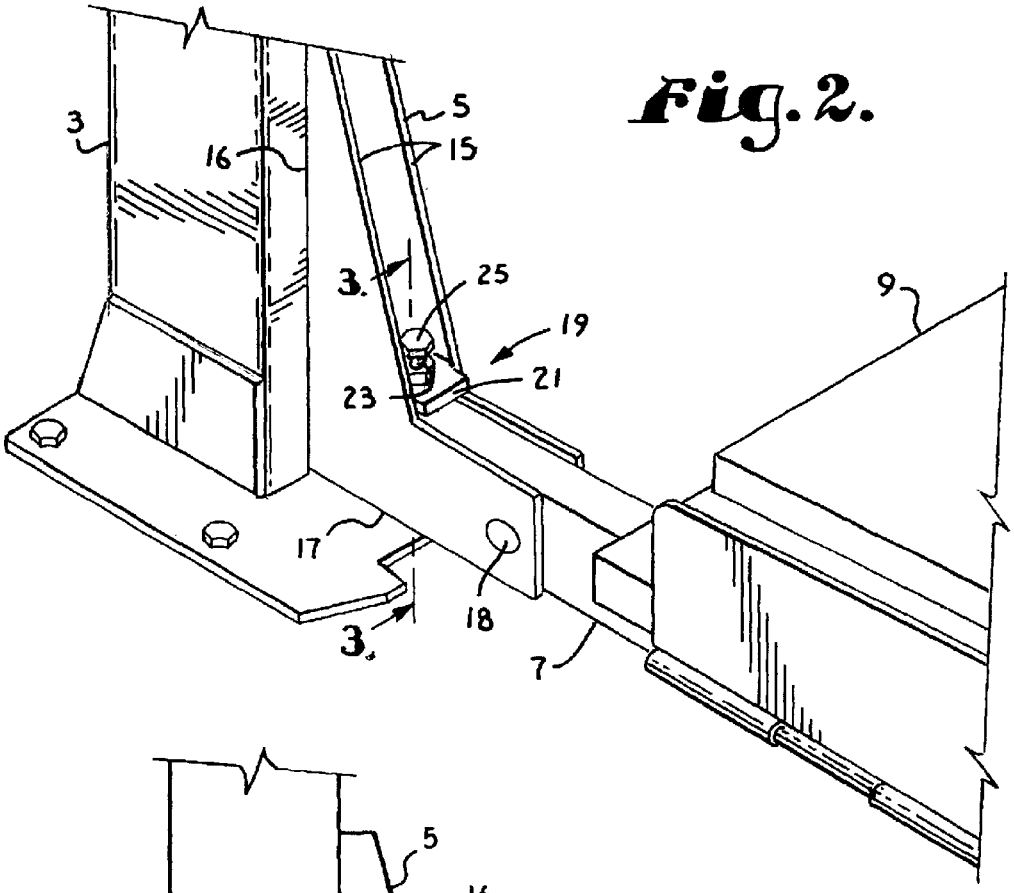
FIG. 2 is an enlarged perspective view of one of the carriages of the lift of FIG. 1.
Figure 3:
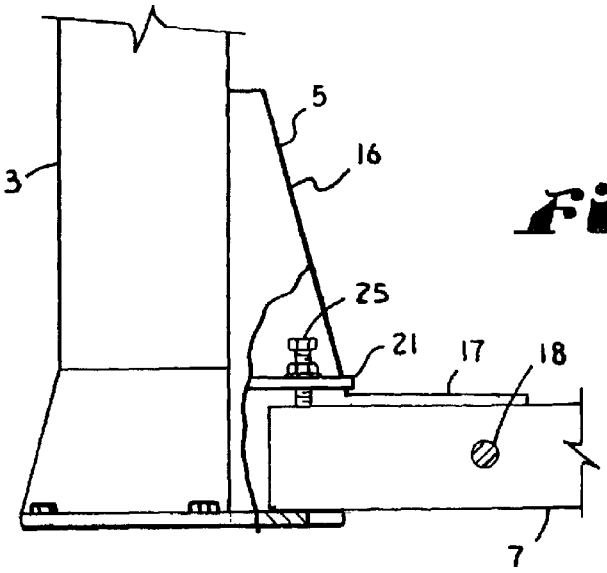
FIG. 3 is a partially cross-sectional view of the carriage of FIG. 2 taken generally along line 3—3 in FIG. 2.

Because each of the carriages 5 is identical to the others, only one of the carriages 5 will be described in detail herein. Referring to FIG. 2, the outrigger 7 is formed of rectangular tubing. The carriage 5 includes a pair of side plates 15 spaced apart from one another to receive the outrigger 7 therebetween. The side plates 15 are shown as being substantially L-shaped, having an upper leg 16 connected to the carriage and a lower leg 17 extending outwardly therefrom. Aligned openings are formed through the lower legs 17 of the side plates 15 and the outrigger 7 to receive a pivot pin 18. The respective runway 9 is supported on the outrigger 7 outboard of the pivot pin 18 such that the runway 9 can be leveled by selectively pivoting the outrigger 7 about the pivot pin 18.

An adjustment mechanism 19 is provided on the carriage 5 for selectively pivoting the outrigger 7. The mechanism 19 includes a stop plate 21 which is fixedly connected between the side plates 15 of the carriage 5 above the outrigger 7. The stop plate 21 includes a threaded receiver 23 which receives an adjusting bolt 25. The adjusting bolt 25 is installed in the receiver 23 such that a lower end of the bolt 25 bears against the top of the outrigger 7 inboard of the pivot pin 18. The head of the bolt 25 extends upwardly from the stop plate 21 so as to be easily accessible by a technician operating the lift 1.

In use, an automobile is driven onto the runways 9 of the lift 1. The carriages 5 are then raised to a desired height. Although the carriages 5 will be raised simultaneously to the same general height, there are typically deviations in the heights of the ends of the runways 9 due to uneven loading exerting different forces on each of the outriggers 7. The technician will, therefore, check the runways to see if they are level. This may be done using any of a variety of known methods including using a bubble level, a laser level, or by measuring the distances between the runways and a known level surface, such as the floor. If the runways 9 are not level, the technician may bring them into level by turning one or more of the adjustment bolts 25 and thereby raising or lowering the respective runway end. Leveling the runways 9 will, in turn, level the vehicle supported thereon.

It is to be understood that while certain forms of the present invention have been illustrated and described herein, it is not to be limited to the specific forms or arrangement of parts described and shown. For example, it is to be understood that the adjustment mechanism 19 could be relocated to a point below the outrigger 7 and outboard of the pivot pin 18. Such a location is not preferred, however, because it would make the adjustment bolt 25 less convenient to access and would increase the clearance required between the outrigger 7 and the floor when the carriage 5 is fully lowered.

In addition, it is foreseen that each adjustment mechanism 19 could include a linear actuator other than an adjustment bolt 25 to cause the respective outrigger 7 to selectively pivot about the pin 18. These other actuators could include mechanical, pneumatic, or hydraulic actuators. For example, it is foreseen that a hydraulic actuator (not shown) could be connected between each outrigger 7 and the respective carriage 5 to permit selected pivoting of the outrigger 7 about the pin 18.

What is claimed is:

1. An automobile service lift comprising a plurality of generally vertical posts, each of said posts having a carriage moveably mounted thereon, each said carriage having an outrigger extending outwardly therefrom toward a longitudinal centerline of said lift, said carriages being operable to lift a vehicle such that a portion of the weight of the vehicle is supported on each of said outriggers, each said outrigger being selectively pivotal relative to the respective carriage about a generally horizontal axis to facilitate leveling of a vehicle supported thereon.

2. The automobile service lift as in claim 1, wherein there are four of said posts including a pair of left side posts and a pair of right side posts, the outriggers associated with said left side posts support a left runway, and the outriggers associated with said right side posts support a right runway.

3. The automobile service lift as in claim 1, wherein each said outrigger is selectively pivotable by a respective adjustment mechanism.

4. The automobile service lift as in claim 3, wherein each said adjustment mechanism comprises a stop plate connected to the respective carriage, said stop plate having a threaded receiver formed therethrough, said threaded receiver receiving an adjustment bolt having an end in rotatable contact with the respective outrigger.

5. The automobile service lift as in claim 1, wherein each said carriage includes a pair of spaced apart side plates, and each said outrigger is pivotally connected between said side plates by a pivot pin which forms said generally horizontal axis.

6. The automobile service lift as in claim 5, wherein each said outrigger is selectively pivotable by a respective adjustment mechanism.

7. The automobile service lift as in claim 6, wherein each said adjustment mechanism comprises a stop plate connected between the side plates of the respective carriage, said stop plate having a threaded receiver formed therethrough, said threaded receiver receiving an adjustment bolt having an end in rotatable contact with the respective outrigger.

8. The automobile service lift as in claim 7, wherein each said stop plate is connected between the side plates of the respective carriage above the respective outrigger and inboard of the respective pivot pin such that said adjustment bolt end contacts an upper surface of said outrigger.

9. An automobile service lift comprising:

a) a plurality of generally vertical posts including a pair of right side posts and a pair of left side posts;

b) a respective carriage moveably mounted on each of said posts;

c) a respective outrigger connected to each of said carriages and extending inwardly toward a centerline of said lift, each said outrigger each being pivotal with respect to the respective carriage about a substantially horizontal axis;

d) left and right runways supported by the outriggers associated with said left side posts and said right side posts, respectively, said runways capable of supporting the weight of an automobile thereon such that a portion of the weight is transmitted to each of said outriggers;

e) a respective adjustment mechanism connected to each of said carriages, each said adjustment mechanism being selectively adjustable to level the respective runway by pivoting the respective outrigger.

10. The automobile service lift as in claim 9, wherein:

a) each said carriage includes a pair of spaced apart side plates;

b) each said outrigger is connected to the respective carriage between the respective side plates by a substantially horizontal pivot pin, said pivot pin forming said substantially horizontal axis; and c) each said adjustment mechanism comprises a stop plate fixedly connected between the side plates of the respective carriage, said stop plate having a threaded receiver formed therethrough, said threaded receiver receiving an adjustment bolt having an end in rotatable contact with the respective outrigger.

11. The automobile service lift as in claim 10, wherein each said stop plate is connected between the side plates of the respective carriage above the respective outrigger and inboard of the respective pivot pin such that said adjustment bolt end contacts an upper surface of said outrigger.

12. An automobile service lift comprising:

a) a plurality of generally vertical posts including a pair of right side posts and a pair of left side posts;

b) a respective carriage moveably mounted on each of said posts, each said carriage including a pair of substantially vertical spaced apart side plates;

c) a drive mechanism connected to said carriages for raising and lowering said carriages;

d) a respective outrigger connected to each of said carriages and extending inwardly toward a centerline of said lift, said outriggers each being pivotally connected between the side plates of the respective carriage by a substantially horizontal pivot pin;

e) left and right runways supported by the outriggers associated with said left side posts and said right side posts, respectively, said runways capable of supporting the weight of an automobile thereon such that a portion of the weight is transmitted to each of said outriggers;

f) a respective adjustment mechanism connected to each of said carriages, each said adjustment mechanism comprising a stop plate connected between the respective side plates above the respective outrigger and inboard of the respective pivot pin, each said stop plate including a threaded receiver which receives a respective adjustment bolt such that a lower end of said adjustment bolt is in rotatable contact with an upper surface of the respective outrigger.

13. An automobile service lift comprising four generally vertical posts including a pair of left side posts and a pair of right side posts, each of said posts having a carriage moveably mounted thereon, each said carriage having an outrigger extending outwardly therefrom, the outriggers associated with said left side posts supporting a left runway and the outriggers associated with said right side posts supporting a right runway, said carriages being operable to lift a vehicle such that a portion of the weight of the vehicle is supported on each of said outriggers, each said outrigger being selectively pivotal relative to the respective carriage about a generally horizontal axis to facilitate leveling of a vehicle supported thereon.

14. An automobile service lift comprising a plurality of generally vertical posts, each of said posts having a carriage moveably mounted thereon, each said carriage having an outrigger extending outwardly therefrom, said carriages being operable to lift a vehicle such that a portion of the weight of the vehicle is supported on each of said outriggers, each said outrigger being selectively pivotal relative to the respective carriage about a generally horizontal axis by a respective adjustment mechanism to facilitate leveling of a vehicle supported thereon, each said adjustment mechanism comprising a stop plate connected to the respective carriage, said stop plate having a threaded receiver formed therethrough, said threaded receiver receiving an adjustment bolt having an end in rotatable contact with the respective outrigger.

15. An automobile service lift comprising a plurality of generally vertical posts, each of said posts having a carriage moveably mounted thereon, each said carriage including a pair of spaced apart side plates and having an outrigger extending outwardly therefrom, each said outrigger being connected between the side plates of the respective carriage by a generally horizontal pivot pin, said carriages being operable to lift a vehicle such that a portion of the weight of the vehicle is supported on each of said outriggers, each said outrigger being selectively pivotable by a respective adjustment mechanism about a the respective pivot pin to facilitate leveling of a vehicle supported thereon, each said adjustment mechanism comprising a stop plate connected between the side plates of the respective carriage and having a threaded receiver formed therethrough, said threaded receiver receiving an adjustment bolt having an end in rotatable contact with the respective outrigger.

16. The automobile service lift as in claim 15, wherein each said stop plate is connected between the side plates of the respective carriage above the respective outrigger and inboard of the respective pivot pin such that said adjustment bolt end contacts an upper surface of said outrigger.

* * * * *